US007735760B2

(12) United States Patent
Hanson et al.

(10) Patent No.: US 7,735,760 B2
(45) **Date of Patent: *Jun. 15, 2010**

(54) FOOD WASTE DISPOSER GRINDING MECHANISM

(75) Inventors: Steven P. Hanson, Racine, WI (US); Richard A. Junk, Elkhorn, WI (US); Cynthia C. Jara-Almonte, Kenosha, WI (US); Thomas R. Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/747,491

(22) Filed: May 11, 2007

(65) Prior Publication Data

US 2007/0221765 A1 Sep. 27, 2007

Related U.S. Application Data

(62) Division of application No. 10/906,654, filed on Feb. 28, 2005, now Pat. No. 7,337,996.

(60) Provisional application No. 60/521,151, filed on Feb. 27, 2004.

(51) Int. Cl.
*E03C 1/266* (2006.01)

(52) U.S. Cl. ..... 241/46.013; 241/DIG. 38

(58) Field of Classification Search ..... 241/46.013, 241/DIG. 38, 162, 88.1, 89.3, 73, 74, 86.1
See application file for complete search history.

(56) References Cited

U.S. PATENT DOCUMENTS

| | | | | |
|---|---|---|---|---|
| 2,697,558 A | | 12/1954 | Powers | |
| 2,808,866 A | * | 10/1957 | Townsend | 241/86.1 |
| 2,938,558 A | * | 5/1960 | Urschel | 241/88.1 |
| 2,940,677 A | | 6/1960 | Jordan | |
| 2,950,065 A | | 8/1960 | Smith et al. | |
| 3,236,462 A | * | 2/1966 | Stout | 241/46.016 |
| 3,628,740 A | * | 12/1971 | Tako et al. | 241/12 |
| 4,128,210 A | | 12/1978 | Brenner et al. | |
| 5,326,038 A | * | 7/1994 | Nilsson | 241/74 |
| 6,109,551 A | | 8/2000 | Sullivan | |
| 2003/0066914 A1 | | 4/2003 | Jara-Almonte et al. | |

FOREIGN PATENT DOCUMENTS

| | | |
|---|---|---|
| GB | 630494 | 10/1949 |
| GB | 719509 | 12/1954 |
| GB | 996678 | 6/1965 |
| KR | 1999-001568 | 1/1999 |
| KR | 20-0245093 | 11/2001 |
| KR | 20-0432685 | 12/2006 |

OTHER PUBLICATIONS

International Search Report and Written Opinion of the International Searching Authority for PCT/US2008/088443, Filed on Dec. 29, 2008.

* cited by examiner

*Primary Examiner*—Faye Francis
(74) *Attorney, Agent, or Firm*—Harness, Dickey & Pierce, P.L.C.

(57) ABSTRACT

A grinding mechanism for a food waste disposer includes a grinding ring defining a plurality of window openings therethrough. A backing member receives the grinding ring and defines a plurality of cavities therein corresponding to the window openings. A plurality of stacked disks form a rotatable shredder plate that is situated to rotate relative to the grinding plate.

25 Claims, 8 Drawing Sheets

FOOD WASTE DISPOSER GRINDING MECHANISM

CROSS-REFERENCE TO RELATED APPLICATION

This application is a divisional of U.S. patent application Ser. No. 10/906,654 filed on Feb. 28, 2005, now U.S. Pat. No. 7,337,996, which is a non-provisional application of U.S. Provisional Application Ser. No. 60/521,151, filed on Feb. 27, 2004. The disclosures of these applications are incorporated by reference herein.

BACKGROUND OF THE INVENTION

The present disclosure relates generally to food waste disposers, and more particularly, to grinding mechanisms for food waste disposers.

Food waste disposers are used to comminute food scraps into particles small enough to safely pass through household drain plumbing. A conventional disposer includes a food conveying section, a motor section, and a grinding mechanism disposed between the food conveying section and the motor section. The food conveying section includes a housing that forms an inlet for receiving food waste and water. The food conveying section conveys the food waste to the grinding mechanism, and the motor section includes a motor imparting rotational movement to a motor shaft to operate the grinding mechanism.

The grind mechanism that accomplishes the comminution is typically composed of a rotating shredder plate with lugs and a stationary grind ring. The motor turns the rotating shredder plate and the lugs force the food waste against the grind ring where it is broken down into small pieces. Once the particles are small enough to pass out of the grinding mechanism, they are flushed out into the household plumbing.

FIG. 1 illustrates a typical grinding mechanism 10. The illustrated grinding mechanism 10 includes a grinding plate 12 with swivel lugs 14 and a stationary grind ring 16. The grinding plate 12 is mounted to the motor shaft 18. The grind ring 16, which includes a plurality of notches 20 defining spaced teeth 21, is fixedly attached to an inner surface of a housing 22.

In the operation of the food waste disposer, the food waste delivered by the food conveying section to the grinding mechanism 10 is forced by the swivel lugs 14 against the teeth 21 of the grind ring 16. The edges of the teeth 21 grind the food waste into particulate matter sufficiently small to pass from above the grinding plate 12 to below the grinding plate 12 via gaps between the rotating and stationary members. Due to gravity, the particulate matter that passes through the gaps between the teeth 21 drops onto the upper end frame 24 and, along with water injected into the disposer, is discharged through a threaded discharge outlet 26. Size control is primarily achieved through controlling the size of the gap through which the food particles must pass.

This type of grinding, however, is much more effective on friable materials than on fibrous materials. Long fibrous and leafy food waste particulates often have escaped the grinding and cutting process in known disposer designs, resulting in longer and larger particulates escaping to the sink trap. This creates problems such as plugged traps and plugged plumbing. Known designs that may be more effective on these types of food wastes are often too costly to mass-produce.

The present application addresses these shortcomings associated with the prior art.

SUMMARY OF THE INVENTION

In accordance with various teachings of the present disclosure, a grinding mechanism for a food waste disposer includes a grinding ring defining a plurality of window openings therethrough. A backing member receives the grinding ring and defines a plurality of cavities therein corresponding to the window openings. In certain exemplary embodiments, the grinding ring further defines a plurality of notches therein, which may alternate with the windows around the periphery of the grinding ring.

In accordance with other aspects of the present disclosure, a grinding mechanism for a food waste disposer includes a plurality of disks stacked to form a rotatable shredder plate. The shredder plate is situated to rotate relative to the grinding ring. In some exemplary embodiments, at least one of the stacked disks defines teeth therein, which may lie on different planes. A support member may also be attached to at least one of the disks, and define lugs extending through openings in the disks. Moreover, in exemplary embodiments, the disks define different radiuses and/or thicknesses.

BRIEF DESCRIPTION OF THE DRAWINGS

Other objects and advantages of the invention will become apparent upon reading the following detailed description and upon reference to the drawings in which.

Figure 1:
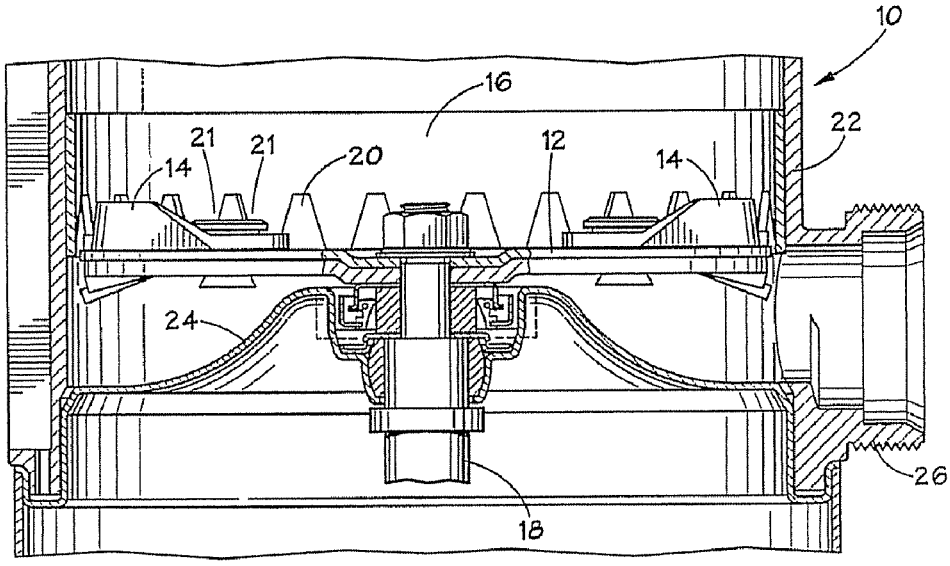
FIG. 1 (PRIOR ART)
FIG. 1 is a sectional view of a prior art food waste disposer grinding mechanism.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
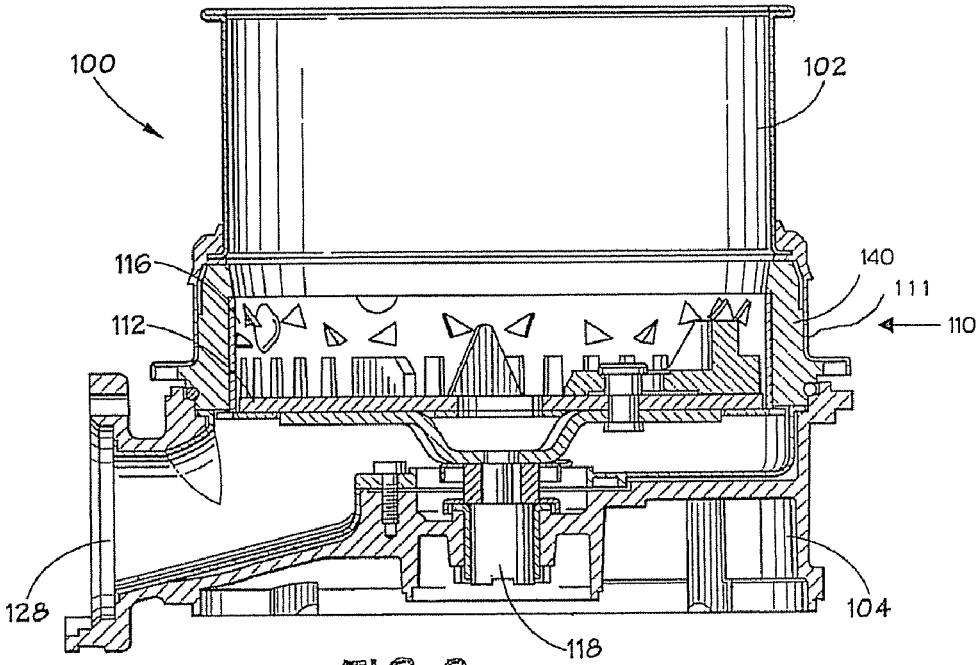
FIG. 2 is a sectional side view showing portions of a food waste disposer embodying aspects of the present disclosure.

FIG. 2 illustrates portions of an exemplary food waste disposer embodying aspects of the present invention. The food waste disposer 100 includes a food conveying section 102 and a grinding mechanism 110, which is disposed between the food conveying section 102 and a motor section (not shown). The food conveying section 102 includes a housing that forms an inlet for receiving food waste and water. The food conveying section 102 conveys the food waste to the grinding mechanism 110, and the motor section includes a motor imparting rotational movement to a motor shaft 118 to operate the grinding mechanism 110

The grinding mechanism 110 includes a stationary grind ring 116 that is fixedly attached to an inner surface of the housing 111 of the grind mechanism 110. A rotating shredder plate assembly 112 is rotated relative to the stationary grind ring 116 by the motor shaft 118 to reduce food waste delivered by the food conveying section 102 to small pieces. When the food waste is reduced to particulate matter sufficiently small, it passes from above the shredder plate assembly 112, and along with water injected into the disposer, is discharged through a discharge outlet 128.

Figure 3:
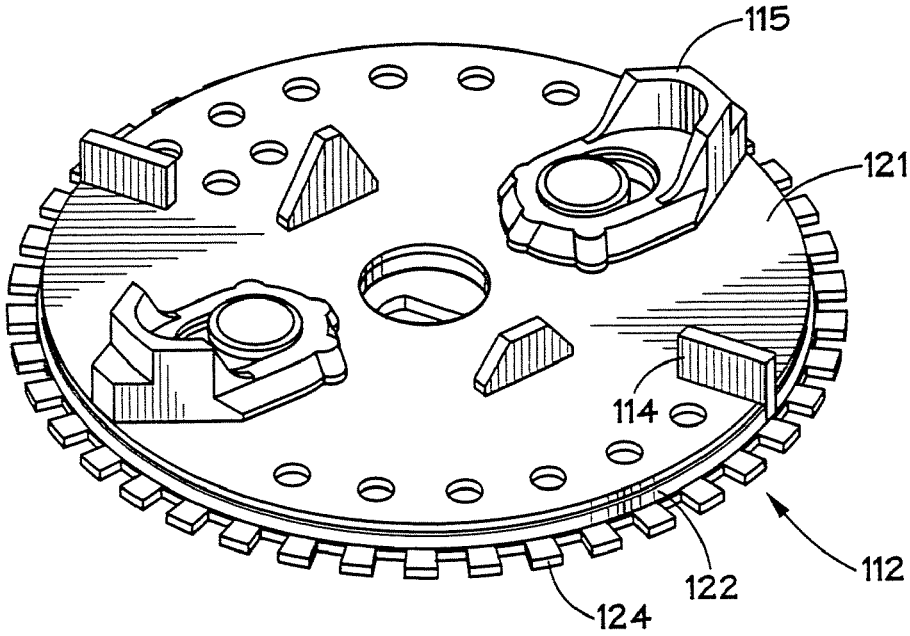
FIGS. 3-5 illustrate aspects of an exemplary stacked shredder plate assembly.
Figure 4:
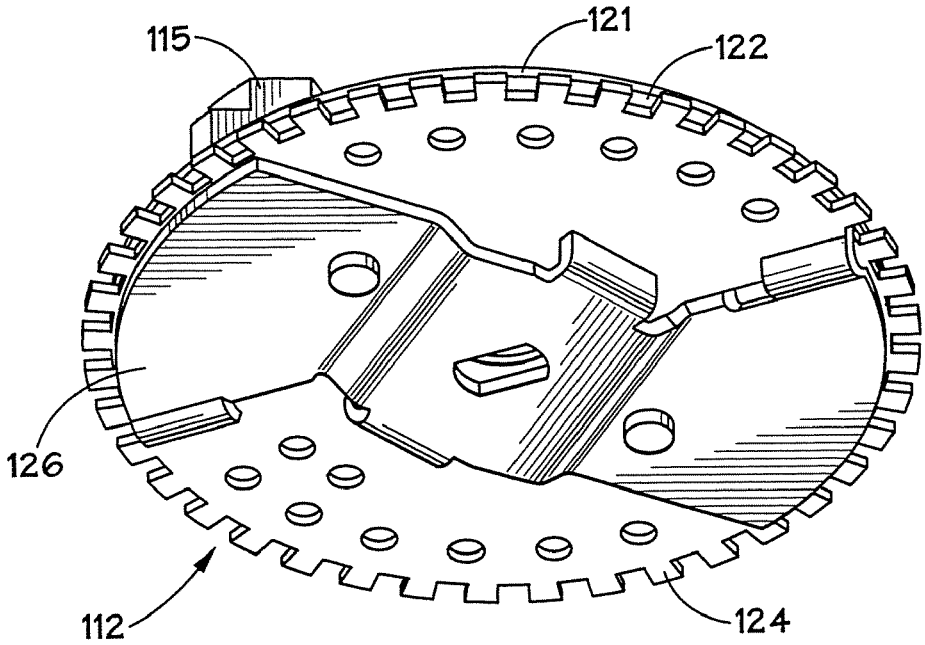
Figure 5:
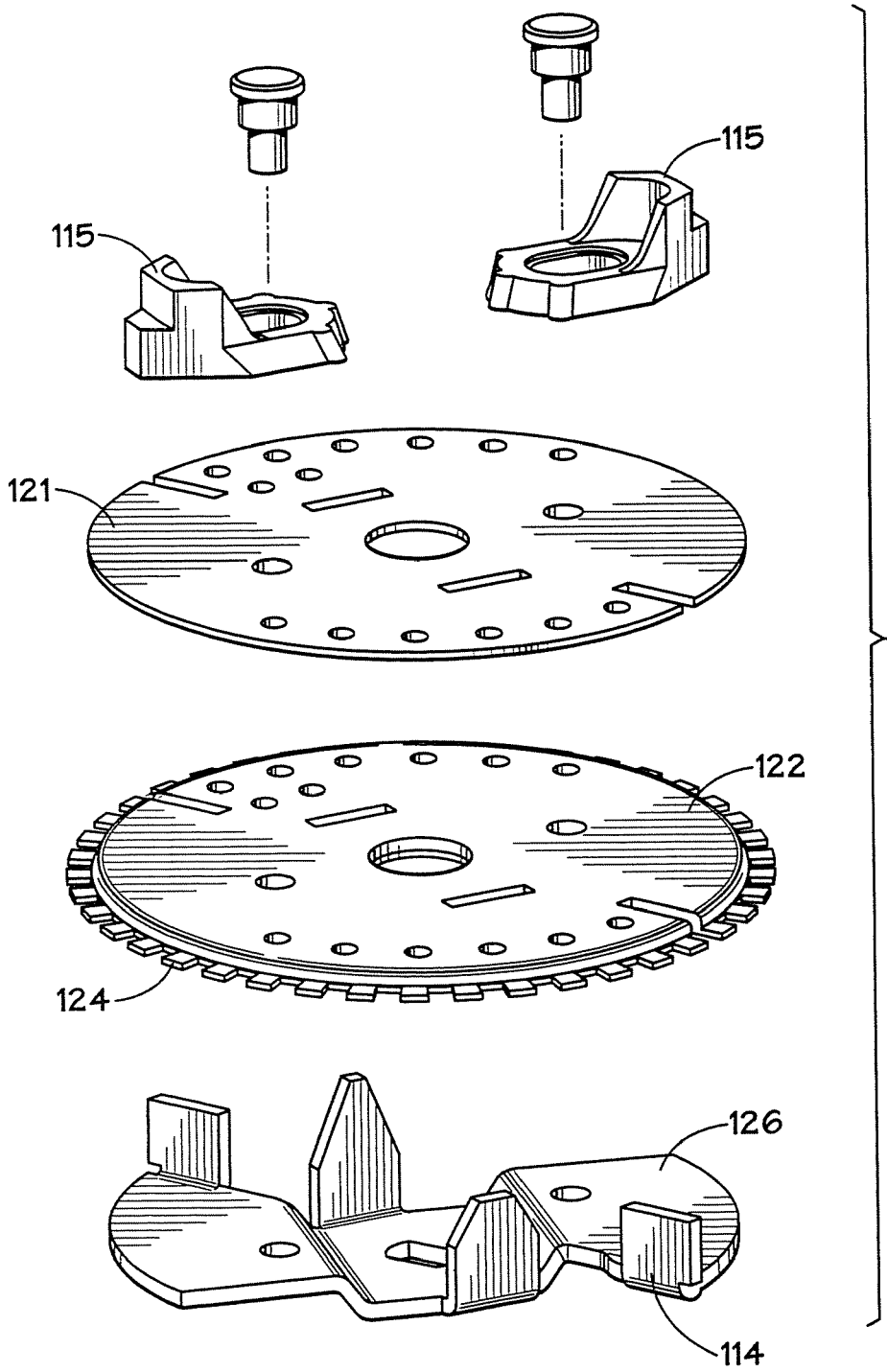
Figure 6:
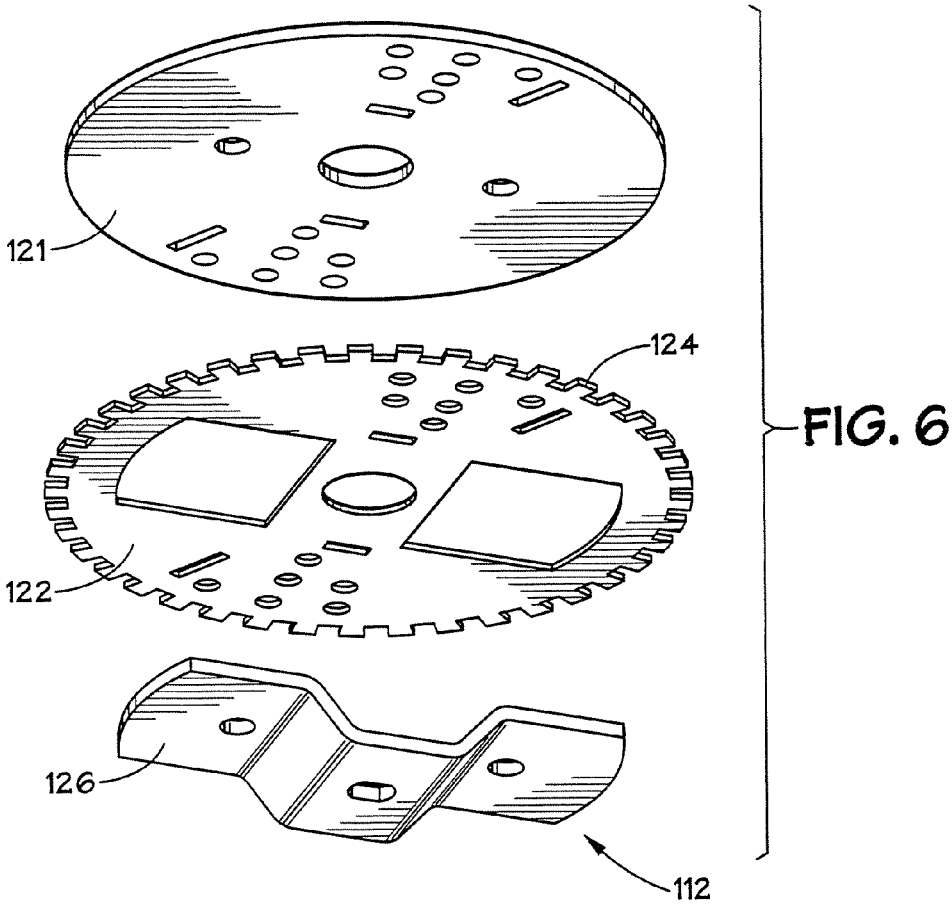
FIGS. 6 and 7 illustrate another exemplary stacked shredder plate assembly.
Figure 7:
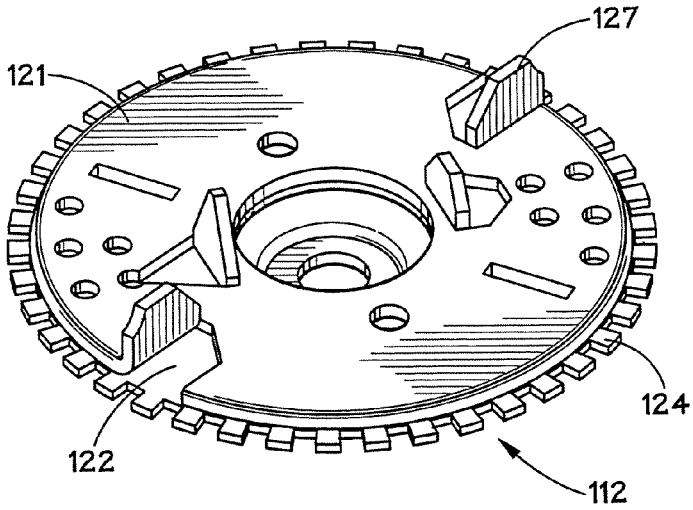

As noted in the Background section hereof, many known grinding mechanisms for food waste disposers do not adequately handle leafy or fibrous food wastes. To better handle such waste, the shredder plate assembly 112 is made up from multiple, stacked plates or disks to provide a plurality of levels for multi-stage chopping or cutting of food waste. FIG. 3 shows an exploded view, and FIGS. 4 and 5 are assembled top and bottom views, respectively, of an embodiment of the shredder plate assembly 112. The illustrated embodiment includes two stacked shredder disks 121, 122 and a support member 126. In some embodiments, the support member 126 includes lugs 114 that extend upwards through openings in the disks 121, 122, as well as swivel lugs 115 attached to the assembly. FIGS. 6 and 7 illustrate a similar embodiment having tabs 127 extending upwards from the top of the upper disk 121.

Figure 8:
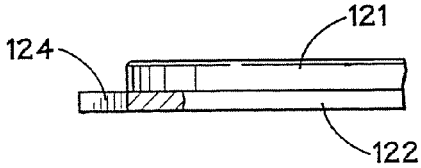
FIG. 8 is a side view conceptually illustrating portions of the embodiments shown in FIGS. 3-7.
Figure 9:
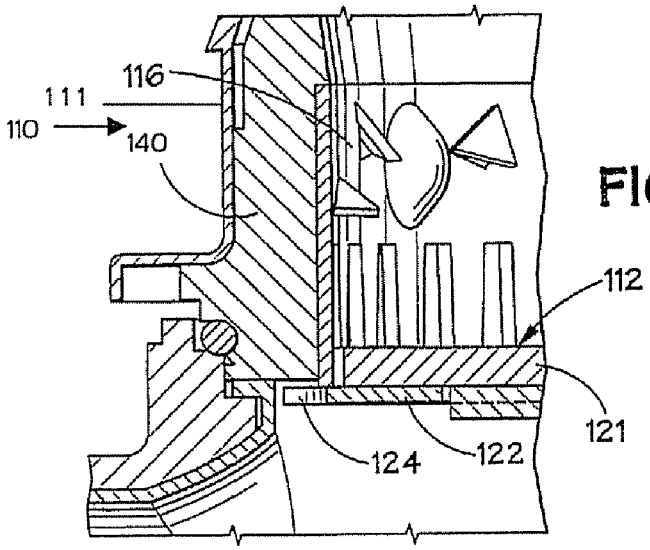
FIG. 9 is a close up view showing part of the food waste disposer illustrated in FIG. 2.

The disks 121, 122 may be made by a stamping process, which is relatively inexpensive and provides sharp corners, angles and levels for cutting the food waste. The lower disk 122 defines teeth 124 about the periphery of the disk 122 for chopping food wastes. Further, in the embodiments shown in FIGS. 3-7, the lower disk 122 defines a radius larger than the upper disk 121, such that the teeth 124 extend beyond the periphery of the upper disk 121. FIG. 8 is a partial side view of the stacked disks 121, 122 showing the teeth 124 of the lower disk 122 extending beyond the upper disk 121. FIG. 9 is a close up view of a portion of the disposer shown in FIG. 2, showing this "under cutting" arrangement, in which the teeth 124 of the lower disk 122 extend below a portion of the grind ring 116.

Figure 10:
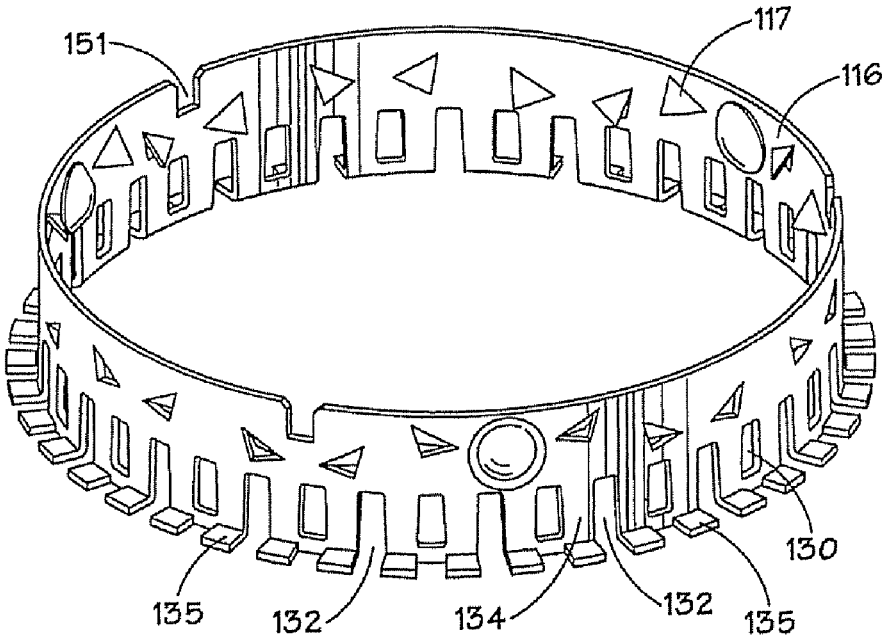
FIGS. 10-12 illustrates exemplary stationary grind ring assemblies in accordance with aspects of the present disclosure.
Figure 11:
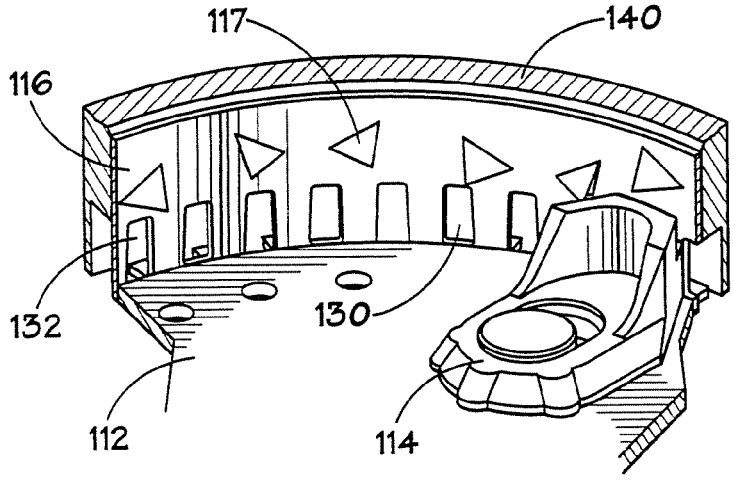

The under cutting arrangement may be especially useful in conjunction with a "pass-through" grind ring assembly that has openings extending through the grind ring 116. FIG. 10 shows one such a grind ring 116. The grind ring 116 shown in FIG. 10 defines windows 130 extending therethrough, and notches 132 that create teeth 134 on the grind ring 116. In other embodiments, such as that shown in FIG. 11, only the windows 130 are defined in the ring 116. A plurality of breaker members 117 are defined by the grinding ring 116, extending towards the center of the ring 116 to break up food waste inside the grinding mechanism 110.

Figure 12:
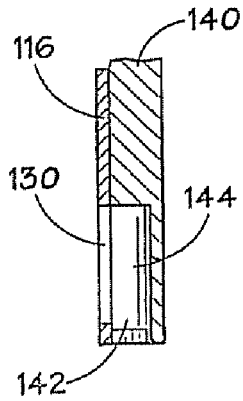

FIG. 12 conceptually illustrates portions of the grinding mechanism 110 in a partial sectional view. A backing member 140, disposed between the grinding ring 116 and housing 111 of grinding mechanism 110 as shown in FIGS. 2 and 9, defines cavities 142 therethrough that correspond to the openings 130,132 through the grinding ring 116, creating a tunnel-like passage 144 behind the openings 130, 132. Now, the food waste can be either broken against, or sheared over, the edges of the openings 130,132. Once the particles are small enough to pass completely through the openings 130, they enter the passage 144 behind the ring 116 and are carried from there by the water flow to the discharge. The inside surface geometry of the backing member 140 creates the passages 144 behind the window openings 130 and teeth openings 132 while supporting, orienting, and limiting rotation of the metal ring 116. To orient and limit rotation of the ring 116, the backing member 140 defines a key that is received by a key way 151 defined in the ring 116.

The fineness of the ground waste is controlled by the size of the openings 130, 132 in the ring 116 as seen by the food waste. The apparent opening size is affected by the rotational speed and the trajectory of the food waste into the ring. It is believed that the fibrous materials are able to partially enter the passage 144 behind the opening 130, 132 and are then sheared off by the passing lug 114. The ability to shear as well as break materials during the grinding improves the fineness on a range of materials.

In the embodiment illustrated in FIG. 10, the teeth 134 forming the openings 132 have a lower surface 135 that is generally perpendicular to the face of the tooth 134 and parallel to the plane of the rotating grinding plate 112. The edges of these lower surfaces 135 create additional cutting surfaces, which, in conjunction with the rotating grinding plate 112, will impart an additional shearing or cutting action to the food particles. This is particularly advantageous in further reducing the size of fibrous materials.

Figure 13:
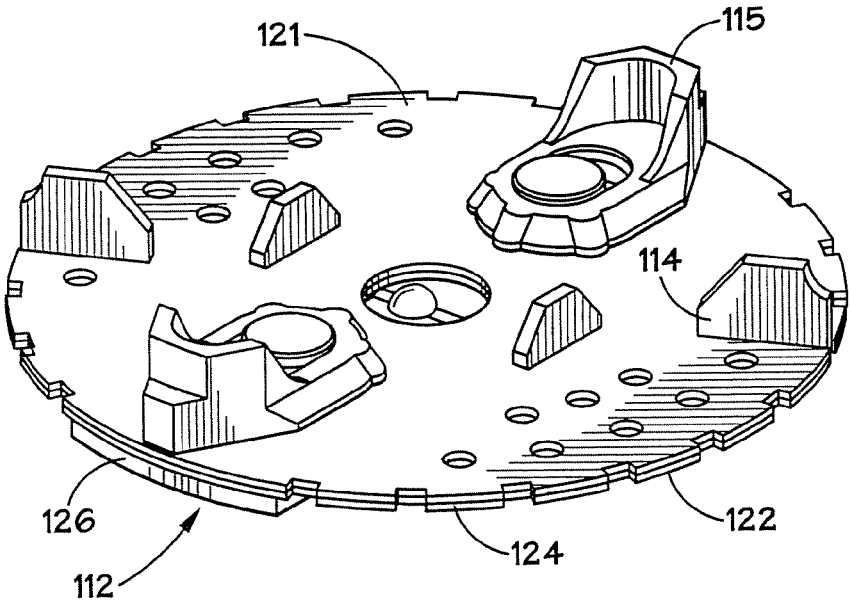
FIGS. 13 and 14 illustrate aspects of another exemplary stacked shredder plate assembly having two stacked disks.
Figure 14:
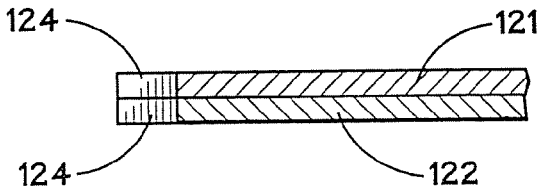

Several different configurations of stacked disks are employed in various embodiments of the shredder plate assembly 112. In addition to the lower disk having a larger radius with teeth extending beyond the periphery of the upper disk as is shown in FIGS. 3-8, some alternative configurations include disks having approximately the same radius, with teeth defined in one or both of the disks. FIGS. 13 and 14 show an assembly 112 including disks 121, 122 having approximately the same radius, with teeth 124 in both disks. Lugs 115 are attached to the upper disk 121, with additional fixed lugs 114 extending up through the disks 121, 122 from the support member 126. To achieve the desired cutting performance, the size of the teeth 124 may be varied, and the teeth 124 may either be in line as shown in FIG. 13, or off set.

Figure 15:
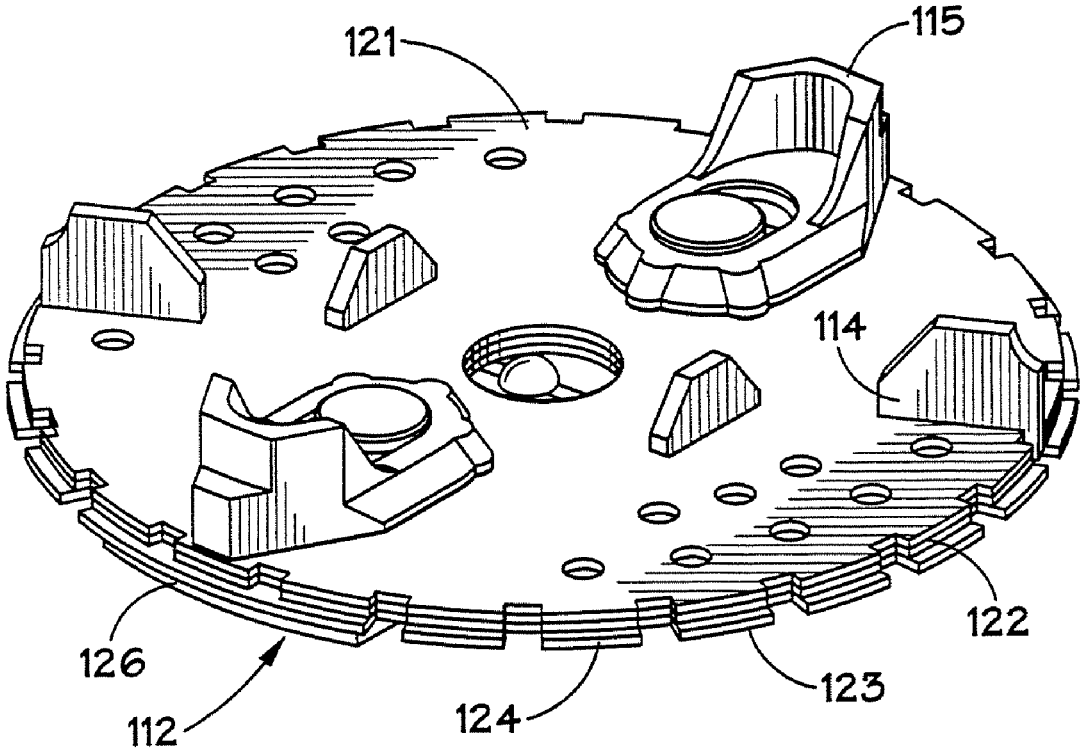
FIGS. 15 and 16 illustrate aspects of a further exemplary stacked shredder plate assembly having three stacked disks.
Figure 16:
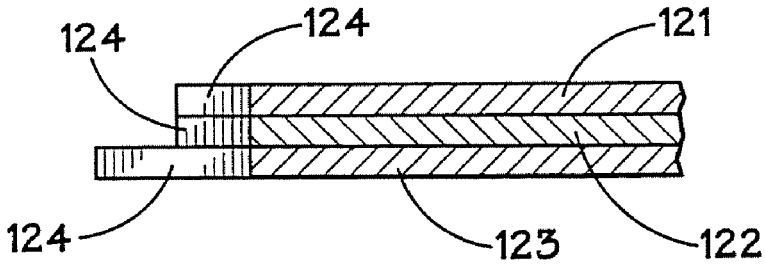
Figure 17:
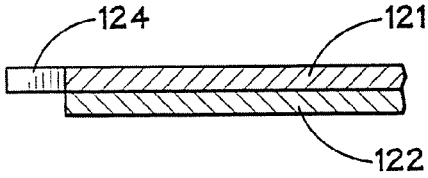
FIGS. 17 and 18 conceptually illustrate aspects of still further exemplary stacked shredder plate assemblies.
Figure 18:
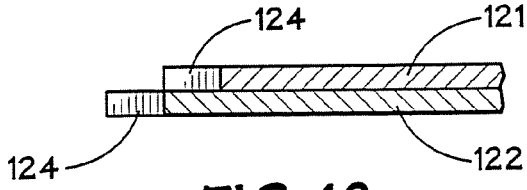

FIGS. 15 and 16 show another embodiment having three stacked disks 121, 122, 123, with each of the disks defining teeth 124. In the particular embodiment shown in FIGS. 15 and 16, the teeth 124 of the lowest disk 123 extend beyond the periphery of the upper disks 121, 122. Other exemplary alternative embodiments are conceptually shown in FIGS. 17 and 18. In FIG. 17, the upper disk 121 has a larger radius and defines teeth 124. FIG. 18 shows a configuration with both disks 121, 122 defining teeth 124 therein, with the lower disk 122 defining a larger radius. Additionally, the thickness of the various disks is varied in some embodiments. For example, in the exemplary embodiments shown in FIGS. 3-8, the upper disk 121 is thicker than the lower disk 122.

Figure 19:
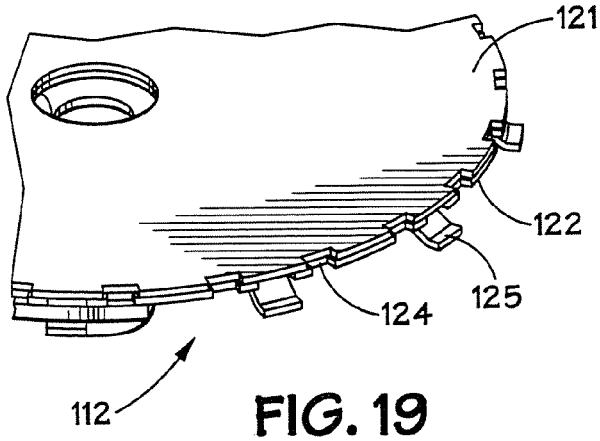
FIGS. 19 and 20 illustrate aspects of yet another exemplary stacked shredder plate assembly.
Figure 20:
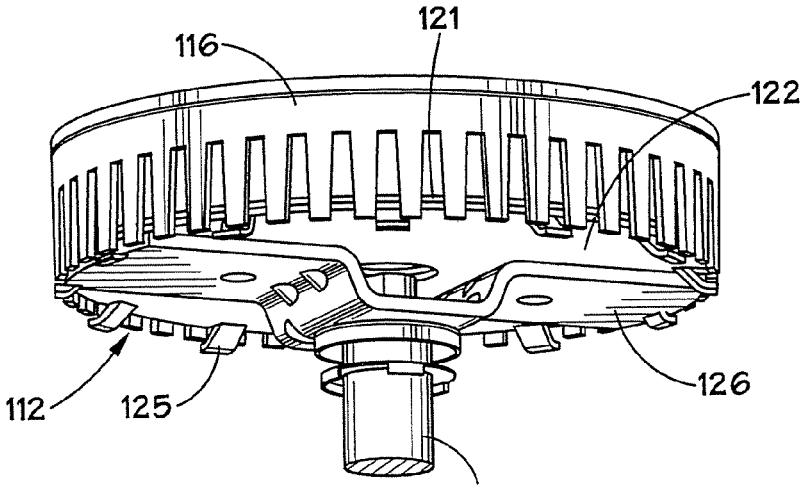

FIG. 19 shows yet another embodiment, in which the lower disk 122 defines teeth 125 that have been bent downwards such that they do not lie on the same plane as the disk 122 itself. FIG. 20 illustrates the assembly 112 shown in FIG. 19 attached to the motor shaft 118 and positioned relative to the stationary grind ring 116. These cut and bent tangs or teeth 125, in addition to the other teeth 124, result in cutting surfaces on a plurality of staggered planes.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A grinding mechanism for a food waste disposer, comprising:

a housing, a stationary grinding ring and a backing member disposed between the grinding ring and the housing;

the grinding ring having a plurality of window openings therethrough and a plurality of notches therein wherein the notches and window openings alternate around a periphery of the grinding ring; and the backing member having a plurality of cavities therein corresponding to the window openings.

2. The grinding mechanism of claim 1, wherein the grinding ring further includes a plurality of radially inwardly extending breaker members.

3. The grinding mechanism of claim 1, wherein the backing member is made of plastic.

4. A grinding mechanism for a food waste disposer, comprising:

a housing, a stationary grinding ring and a backing member disposed between the grinding ring and the housing;

the grinding ring having a plurality of window openings therethrough;

the backing member having a plurality of cavities therein corresponding to the window openings;

a rotatable shredder plate situated to rotate relative to the grinding ring, the shredder plate including a plurality of disks stacked together.

5. The grinding mechanism of claim 4, further including a lug attached to the shredder plate.

6. The grinding mechanism of claim 4, wherein at least one of the disks has a plurality of radially outwardly extending teeth about its periphery.

7. The grinding mechanism of claim 6, wherein the disks include an upper disk and a lower disk, the lower disk including the teeth and the teeth extend radially outwardly from the periphery of the lower disk in a plane different than a plane in which a body of the lower disk lies.

8. The grinding mechanism of claim 4, wherein the shredder plate includes a support member.

9. The grinding mechanism of claim 8, wherein the support member includes lugs extending through openings in the disks.

10. The grinding mechanism of claim 4, wherein the disks have different radiuses.

11. The grinding mechanism of claim 4, wherein the disks have different thicknesses.

12. A food waste disposer system, comprising:

a grinding mechanism, the grinding mechanism including a housing, a stationary grinding ring, a backing member disposed between the grinding ring and the housing, and a rotatable shredder plate assembly;

the grinding ring having a plurality of window openings therethrough;

the backing member having a plurality of cavities therein corresponding to the window openings;

a motor driving the rotatable shredder plate assembly; and a food conveying section having a housing having an inlet that receives food waste and that conveys the food waste to the grinding mechanism.

13. The food waste disposer of claim 12, wherein the grinding ring includes a plurality of notches therein.

14. The food waste disposer of claim 13, wherein the notches and windows alternate around a periphery of the grinding ring.

15. The food waste disposer of claim 12, wherein the grinding ring further includes a plurality of radially inwardly extending breaker members.

16. The food waste disposer of claim 12, wherein the backing member is made of plastic.

17. The food waste disposer of claim 12, further including a rotatable shredder plate situated to rotate relative to the grinding ring.

18. The food waste disposer of claim 17, further including a lug attached to the shredder plate.

19. The food waste disposer of claim 17, wherein the shredder plate includes a plurality of disks stacked together.

20. The food waste disposer of claim 19, wherein at least one of the disks has a plurality of radially outwardly extending teeth about its periphery.

21. The food waste disposer of claim 20, wherein the disks include an upper disk and a lower disk, the lower disk including the teeth and the teeth extend radially outwardly from the periphery of the lower disk in a plane different than a plane in which a body of the lower disk lies.

22. The food waste disposer of claim 19, wherein the shredder plate includes a support member.

23. The food waste disposer of claim 22, wherein the support member includes lugs extending through openings in the disks.

24. The food waste disposer of claim 19, wherein the disks have different radiuses.

25. The food waste disposer of claim 19, wherein the disks have different thicknesses.

* * * * *